United States Patent [19]

Nakajima et al.

[11] Patent Number: 4,702,087

[45] Date of Patent: Oct. 27, 1987

[54] CEILING SUSPENDED AIR CONDITIONER

[75] Inventors: Isamu Nakajima; Yasuo Nakashima; Nobuyuki Miyazaki; Kazuo Ishino, all of Shizuoka, Japan

[73] Assignee: Mitsubishi Denki Kabushiki Kaisha, Tokyo, Japan

[21] Appl. No.: 844,644

[22] Filed: Mar. 27, 1986

[30] Foreign Application Priority Data

| | | | |
|---|---|---|---|
| Mar. 29, 1985 | [JP] | Japan | 60-46060[U] |
| Mar. 29, 1985 | [JP] | Japan | 60-46063[U] |
| May 15, 1985 | [JP] | Japan | 60-71625[U] |
| Jul. 2, 1985 | [JP] | Japan | 60-100783[U] |
| Oct. 31, 1985 | [JP] | Japan | 60-167959[U ] |
| Oct. 31, 1985 | [JP] | Japan | 60-167960[U] |

[51] Int. Cl.[4] ..... F25D 21/14

[52] U.S. Cl. ..... 62/285; 62/290; 62/DIG. 16

[58] Field of Search ..... 62/285, 288, 289, 290, 62/291, 259.1, DIG. 16

[56] References Cited

U.S. PATENT DOCUMENTS

| | | | |
|---|---|---|---|
| 2,750,759 | 6/1956 | Harle | 62/291 |
| 3,097,507 | 7/1963 | Makuh | 62/285 |
| 3,596,475 | 8/1971 | Berger | 62/285 |

FOREIGN PATENT DOCUMENTS

| | | |
|---|---|---|
| 54-166043 | 11/1979 | Japan . |
| 55-126131 | 9/1980 | Japan . |
| 56-38235 | 4/1981 | Japan . |
| 2102114 | 1/1983 | United Kingdom . |

*Primary Examiner*—Harry Tanner

*Attorney, Agent, or Firm*—Sughrue, Mion, Zinn, Macpeak and Seas

[57] ABSTRACT

An improved air conditioner for supplying temperature-controlled air to the interior of a room from a ceiling position where the air conditioner is installed without danger of condensate dripping from the air conditioner into the room. Air is sucked from an outer case intake vent into a heat exchanger and the cooled air is blown into the room with blowers. The heat exchanger and the blowers are installed in a suspended outer case in a space above the ceiling of the room. The air sucked from the intake vent is led to air supply vents provided on both sides of the undersurface of the outer case through the air supply trunk, the air supply trunk being divided into sections by a bulkhead.

3 Claims, 31 Drawing Figures

CEILING SUSPENDED AIR CONDITIONER

BACKGROUND OF THE INVENTION

The present invention relates to an air conditioner.

FIG. 1 is a side vertical sectional view of a conventional overhead recessed air conditioner as disclosed in Japanese Laid-Open Utility Model Appln. No. 54-166043, and FIG. 2 is an elevational view of the same. An air conditioner body 4 is mounted in an outer case 5 suspended from a ceiling beam 2 of a building 1 by bolts 3, the outer case 5 containing a heat exchanger 6 and a blower 7. The air conditioner further includes an intake vent 8, a supply vent 9, an electrical parts box 10 attached to one side of the outer case 5 and containing a power supply terminal board, a control board, etc. (not shown), and a pipe 11 installed on the supply side of the outer case 5 and coupled to a duct. The air conditioner is installed on ceiling plate 12.

The conventional overhead recessed air conditioner thus constructed has only one air supply vent, which opens towards the ceiling. Consequently, a duct must be installed to introduce the cooled air into the room, which is disadvantageous in that, even if the air is introduced into the room through the duct, the indoor air temperature distribution may be uneven because there is provided only one supply vent.

Another conventional overhead recessed air conditioner will be described below.

FIG. 3 is a side view illustrating a partial section of conventional overhead recessed air conditioner as disclosed in Japanese Laid-Open Utility Model Appln. No. 55-126131. In FIG. 4, there is shown an air conditioner body 101 installed in a space C above a ceiling plate A, the air conditioner body being suspended from a ceiling beam B and fixed with suspension bolts 102 and having a decorative panel 103 attached to the undersurface 101*a* of the body 101 fitted in the opening of the ceiling plate A with set bolts 104, and air intake vent 105, air supply vents 106, louvers 107, and a filter 108.

The method of installing such a conventional air conditioner includes steps of fixing the body 101 to the ceiling beam B with the suspension bolts 102 so as to place it in the space C above the ceiling plate A, and setting and attaching the decorative panel 103 in position with the set bolts 104.

In the conventional overhead recessed air conditioner thus constructed, the appearance of the unit will be marred unless the decorative panel is installed in close in contact with the undersurface of the ceiling plate A. Moreover, if the body 101 and the decorative panel 103 are incompletely adhesion-bonded as shown in FIG. 4, not only leakage of air toward the space C above the ceiling plate, but also air short-circuiting between the supply vents and the intake vent will occur, whereby condensation of moisture on the outer wall and a reduction in efficiency result.

Because of the above-described problems, a great deal of care must be paid to the installation of the air conditioner. Since the body 101 must be separated from the decorative panel 103, furthermore, the resulting large size of the product during shipment is detrimental to transport efficiency because the decorative panel 103 is larger than the body 101 in size. In addition to these problems, the conventional air conditioner has other disadvantages in that, if the body and the decorative panel are separately packed, packaging and handling costs of the product are increased.

Still another conventional overhead recessed air conditioner will be described below.

FIG. 5 is a sectional view of a conventional overhead recessed air conditioner as disclosed in Japanese Laid-Open Utility Model Appln. No. 55-126131, for instance, wherein there is shown an air conditioner body 201 suspended from a ceiling slab 203 through suspension bolts 202. The air conditioner attached to a ceiling 205 includes a decorative grille 204 attached to its body 201 with set bolts 206, an intake vent 207, and supply vents 208. The method of installing the air conditioner includes steps of suspending the body 201 from the slab 203, fixing the body 201 to the ceiling with the suspension bolts 202, and attaching the decorative panel 204 to the body 201 from outside the ceiling 205 with the bolts 206.

In the conventional air conditioner thus constructed, its appearance will be spoiled unless the decorative panel 204 is installed in such a way that it is in close contact with the ceiling 205 and, if the body 201 and the decorative panel 204 are not completely in contact with each other as shown in FIG. 6, air short-circuiting due to air leakage and condensation on the outer wall will occur.

Yet another conventional air conditioner will be described below.

In an air conditioner of the type disclosed in Japanese Laid-Open Utility Model Appln. No. 56-38235, as shown in FIG. 7, an overhead recessed air conditioner body 301 has a decorative panel attached thereto, the decorative panel having an intake vent 302 and a supply vent arranged on the undersurface thereof. Reference numeral 307 represents the undersurface of the ceiling. A multiblade blower 313 is installed above the intake vent 302 in the body 301, and an air supply passage 9 is formed between the blower 308 and the supply vent 303, a heat exchanger 310 being installed within the supply passage 309. An arrow represents the air flow. Reference numeral 312 represents a condensate collecting pan.

In the air conditioner thus constructed, air is sucked from the room through the intake vent 302 as the blower 308 rotates and is sent to the heat exchanger 310. The air is cooled and dehumidified in the heat exchanger 310 before being blown out of the supply vents 303 for air conditioning purposes.

The air sucked from the intake vent 302 as the blower 308 rotates is sent to the heat exchanger 310 while colliding with the upper side of the air conditioner body 301. The air is then cooled and dehumidified by the heat exchanger 310 before being blown from the supply vent 303 into the room for air conditioning purposes. Moreover, the moisture contained in the air is condensed in the heat exchanger 310 while the air is cooled and dehumidified therein. A condenser collecting pan 312 under the heat exchangers 310 discharges it from the body 310.

The air conditioner of this type is normally installed in the central portion of the ceiling in consideration of its external appearance viewed from the room. Accordingly, it has been difficult to make uniform the air current and temperature distribution.

The reason for such difficulty lies in the fact that the supply vent 303 is provided only on one side of the undersurface of the air conditioner body 301. The body is installed on the ceiling. In other words, the ambient atmosphere where the body is placed has a temperature and humidity higher than the air in the room. The decorative panel located on the undersurface of the ceiling is exposed to the air in the room and thus cooled. Where the sides of the decorative panel come in contact with the air in the ceiling, they will produce condensation 311, which can drop into the room. Furthermore, the drainage collected on the condensate collecting pan 312 is affected by the adjacent air currents because the pan 312 is disposed in the air supply passage in the body 301. Consequently, the flow in the drain may be stopped and the water prevented from being discharged from the body 301, causing the drainage to overflow the pan 312 and to splash into the room through the supply vents 303.

SUMMARY OF THE INVENTION

The present invention is intended to remedy the above-discussed shortcomings, and it is therefore an object of the invention to provide an overhead recessed air conditioner capable of providing an improved indoor air temperature distribution without requiring duct installation.

It is another object of the invention to provide an overhead recessed air conditioner having an improved installation efficiency and product quality stability.

It is still another object of the invention to provide an air conditioner capable of being installed in a modular ceiling for the purpose of improving not only its external appearance but also its installation efficiency without air leakage problems.

It is yet another object of the invention to provide an air conditioner capable of making the air current and temperature distribution uniform to ensure that the air conditioning effect is improvable.

It is a further object of the present invention to provide an air conditioner in which condensation on the sides of a decorative panel is eliminated.

It is still another object of the present invention to provide an air conditioner capable of improving drainage by preventing the air currents from affecting drainage in a condensate collecting pan.

Briefly, in accordance with the present invention, air sucked from an intake vent through a heat exchanger is led to an air supply trunk divided into sections by a bulkhead and blown out of supply vents provided on both sides of the undersurface of an outer case to the interior of a room.

Since the cooled air is directly blown into the room, no duct installation is necessary, and moreover the supply vents provided on both sides of the undersurface contribute to an improvement in the indoor temperature distribution.

The overhead recessed air conditioner according to the present invention has a body combined with a decorative panel, which prevents air leakage and air short-circuiting due to misinstallation. Also, the gap between the ceiling plate and the air conditioner in the direction of its height is filled by attaching a flange to the periphery of an opening in the ceiling plate from below or inserting a separate decorative frame therebetween.

The air conditioner according to the present invention is arranged so that the air conditioner body, having an air intake vent and supply vents on its undersurface, is located in one of the frames of a modular ceiling, and the gap between the body and the frame is filled with a decorative cover.

In the air conditioner according to the present invention, the air conditioner body arranged in the module ceiling is designed so that the decorative cover attached to the outer periphery of the body abuts the frame to fill the gap therebetween. Consequently, the appearance of the installed air conditioner is improved, and it can be readily installed because no decorative grille is necessary.

Further, an air conditioner according to the present invention comprises an air conditioner body having an air intake vent provided in the center on the room side and air supply vents provided on both sides of the intake vent, a pair of heat exchangers arranged opposite each other within the air conditioner body, a blower installed between the heat exchanger and used to send air to the heat exchanger, and a rectifier member formed between the blower and the heat exchanger, the rectifier member being provided with inclines and extending toward the centers of both the supply vents in the supply passages.

According to other aspects of the present invention, the air conditioner body is equipped with an intake vent provided in the central portion facing the room and supply vents provided on both sides of the intake vent, and there is also installed a rectifier member extending toward both the supply vents in the supply passage formed between a blower and both heat exchangers, the rectifier member being provided with inclines. Consequently, the air sucked as the blower rotates is led to the rectifier member and evenly divided into both directions by the inclines before being blown out of the supply vents through both the heat exchangers and then the air conditioner body.

The air conditioner according to the present invention may be supplied with a plurality of oval or oblong slits provided in part of the whole periphery of a decorative panel arranged on the undersurface of the body, the decorative panel having an intake vent and supply vents.

Since slits are provided on the sides of the decorative panel according to the present invention, the heat conductivity of the decorative panel is reduced and the sides thereof are thermally separated from its undersurface exposed to the air in the room and cooled, whereby no dropping condensation will be produced, even if the air in the ceiling touches the sides thereof.

The air conditioner according to the present invention comprises an air conditioner body having an intake vent provided in the central portion on the room side and supply vents provided on both sides of the intake vent, a pair of heat exchangers arranged opposite to each other in the body, a blower arranged between the heat exchangers and used to send air thereto, and a drain directed to a drainage hole formed under the pair of heat exchangers, a cover being provided to form the drain into a covered conduit.

As a drain directed to a drainage hole from under a pair of heat exchangers is provided, a cover also being provided to form the drain into a covered conduit, the drainage flowing in the drain is unaffected by the air current.

BRIEF DESCRIPTION OF THE DRAWINGS

FIG. 1 is a vertical sectional view of the same;

FIG. 2 is an elevational view of the same;

FIG. 8 is a vertical sectional view of the embodiment of FIGS. 8 and 9;

FIG. 9 is a sectional view taken on a line IX—IX in FIG. 8;

DESCRIPTION OF THE PREFERRED EMBODIMENTS

Figure 1:
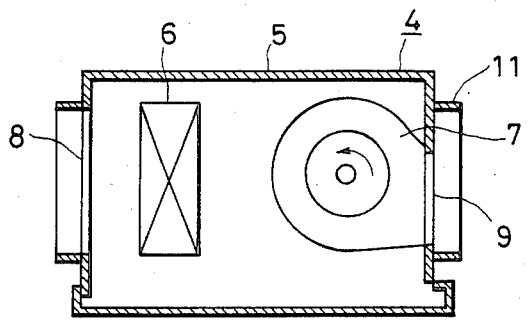
FIG. 1 PRIOR ART
FIGS. 1 and 2 illustrate a first conventional air conditioner.
Figure 2:
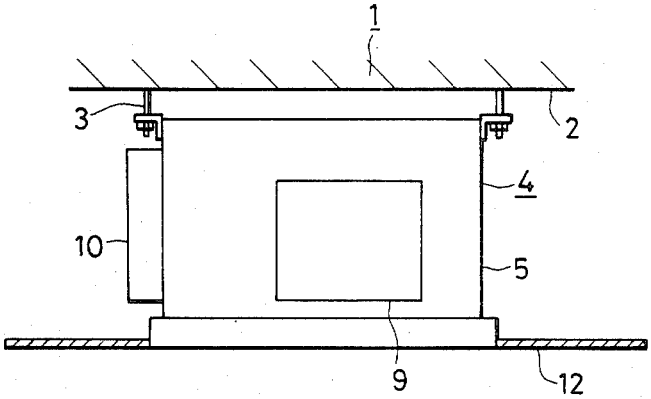
FIG. 2 PRIOR ART
Figure 8:
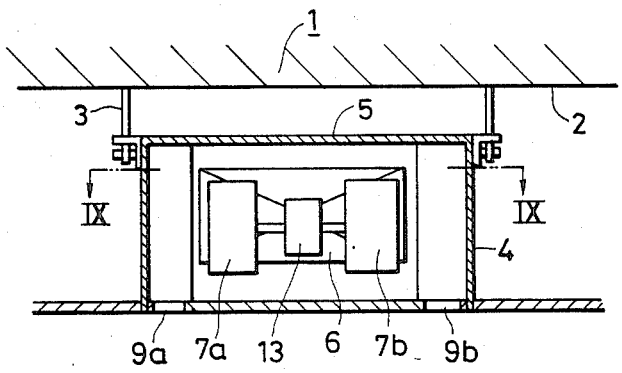
FIGS. 8 and 9 illustrate an embodiment of the present invention.
Figure 9:
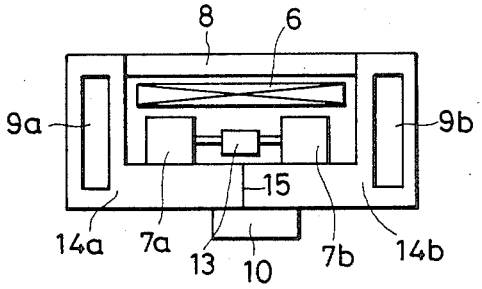

Referring now to FIGS. 8 and 9, a first embodiment of the present invention will be described. In FIGS. 8 and 9, like reference numerals and characters designate like or corresponding parts in FIGS. 1 and 2.

Left and right blowers 7*a*, 7*b* are driven by a bidirectional motor 13, and supply vents 14*a*, 14*b* are provided on both side of the undersurface of an outer box 5, whereas a supply trunk is divided into left and right sections 14*a*, 14*b* by a bulkhead 15.

In the air conditioner thus constructed, the air sucked from the room through an intake vent 8 located in the center of the rear undersurface of an outer case 5 is further sucked into the blowers 7*a*, 7*b* because of their negative pressure and cooled to a desired temperature while passing through a heat exchanger 6. The air is then forced through an air supply trunk divided into left and right sections 14*a*, 14*b* by a bulkhead 15 before being blown out of the supply vents 9*a*, 9*b* provided on both sides of undersurface of the outer case 5.

Figure 4:
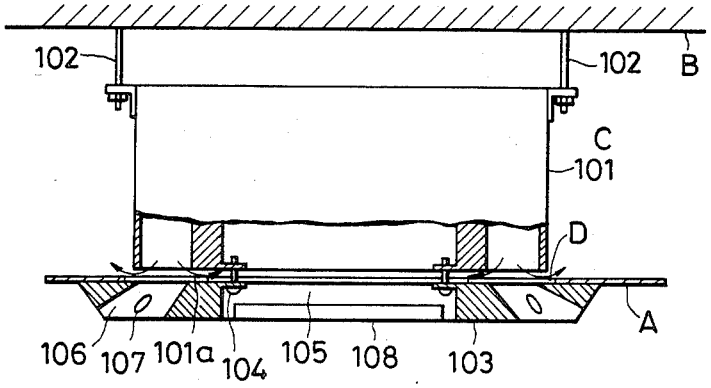
FIG. 4 PRIOR ART
FIG. 4 is a side view with a partial sectional view of the same installed in an incorrect manner.
Figure 5:
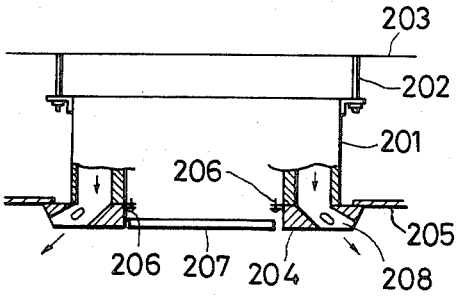
FIG. 5 PRIOR ART
FIGS. 5 and 6 are sectional views of a third conventional air conditioner.
Figure 6:
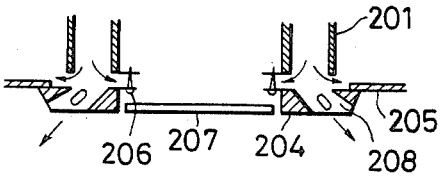
FIG. 6 PRIOR ART
Figure 7:
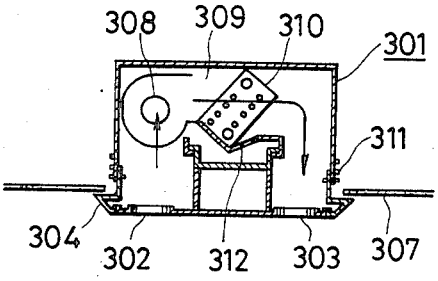
FIG. 7 PRIOR ART
FIG. 7 is a sectional view of a fourth conventional air conditioner.
Figure 10:
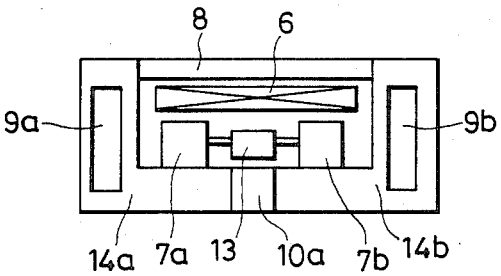
FIG. 10 is a sectional view, similar to FIG. 8, illustrating the second embodiment of the present invention.

FIG. 10 illustrates another embodiment of the present invention, wherein like reference characters designate like or corresponding parts in FIGS. 4 and 5. In this embodiment, an electrical parts box 10*a* is installed and used to divide the air supply trunk into left and right sections. The size of the packing box for transport can thus be reduced because the protrusion on the surface of the outer case 5 is eliminated.

As set forth above, the air sucked from an intake vent and cooled to a desired temperature while passing through a heat exchanger is led to an air supply trunk divided into sections by a bulkhead and blown out of supply vents formed on both sides in the longer direction of the outer case, as a result of which the interior temperature distribution is effectively improved without duct installation.

Figure 11:
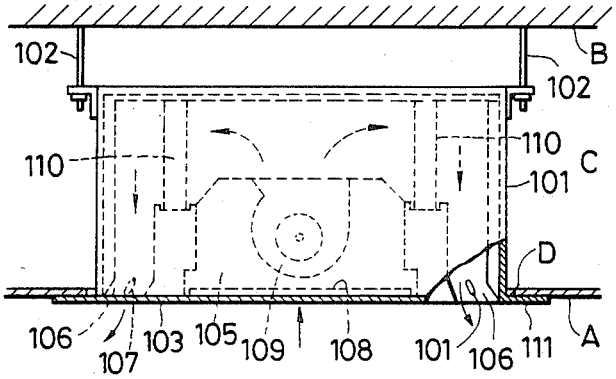
FIG. 11 is a side view including a partial sectional view of a third embodiment of the present invention.

Referring to FIG. 11 of the accompanying drawings, a third embodiment of the present invention will be described.

Figure 3:
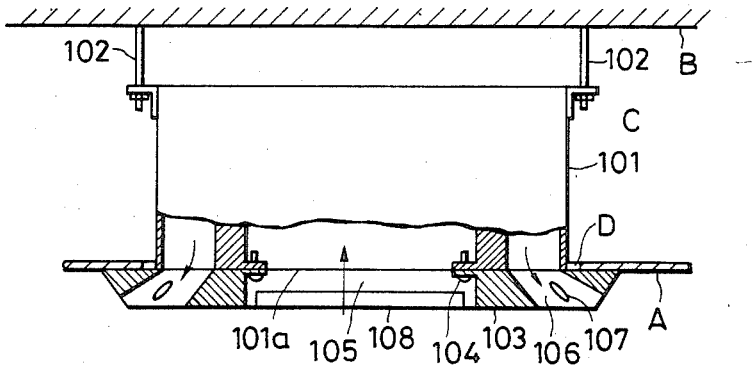
FIG. 3 PRIOR ART
FIG. 3 is a side view with a partial sectional view of a second conventional overhead recessed air conditioner.

In FIG. 11, a body 101 is suspended from the ceiling beam B and fixed with suspension bolts 102, as in the case of conventional example shown in FIG. 3.

A decorative panel 103 is combined with the body 101 on the undersurface thereof, the body further including an air intake vent 105, air supply vents 106, louver 107, a filter 108, a blower 109 and a heat exchanger 110, as in the case of the conventional air conditioner, and a flange 111 formed over the whole periphery of the decorative panel 103 of the body 101, i.e., abutting the periphery D of the opening in the ceiling plate A in such a manner as to fill the gap therebetween.

When the blower 109 in the air conditioner thus constructed is operated, the air will circulate as shown by an arrow. The body 101 and the decorative panel 102 are integrated to ensure that the air is sucked into the intake vent 105 and sent out of the supply vents 106 while preventing the short-circuiting of the air being taken in and blown out and the leakage of the air toward the space C above the ceiling plate A. Moreover, the gap between the opening D of the ceiling plate A and the decorative panel 102 is covered with the flange 111 abutting the undersurface of the ceiling plate A and poses no problem in view of design.

Figure 12:
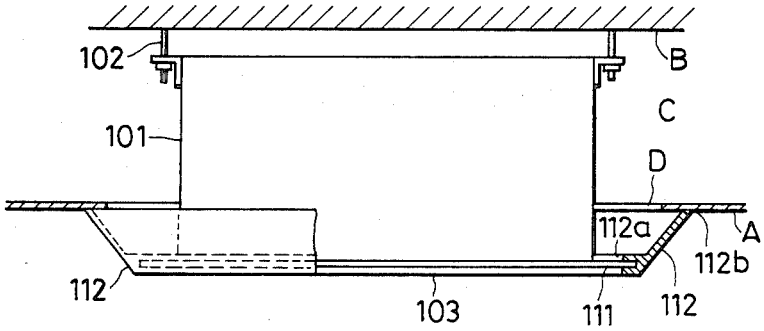
FIG. 12 is a side view with a partial sectional view of a fourth embodiment of the present invention.

Although the flange 111 on the whole periphery of the decorative panel 103 abuts the undersurface of the ceiling plate A in the above-described example, the decorative panel 103 may be lowered below the ceiling plate A, as shown in FIG. 12, when the space C above is ceiling plate is not sufficient to contain the body 101 so as to fill the gap between the ceiling plate A and the decorative panel 103 in the vertical direction by inserting the inner edge 112*a* of a decorative frame 112 in the flange 111 and abutting the outer edge 112*b* on the undersurface of the ceiling plate A.

Figure 13:
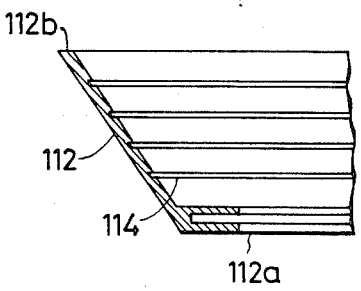
FIG. 13 is a sectional view of the principal portion of a decorative frame for use in the present invention.
Figure 14:
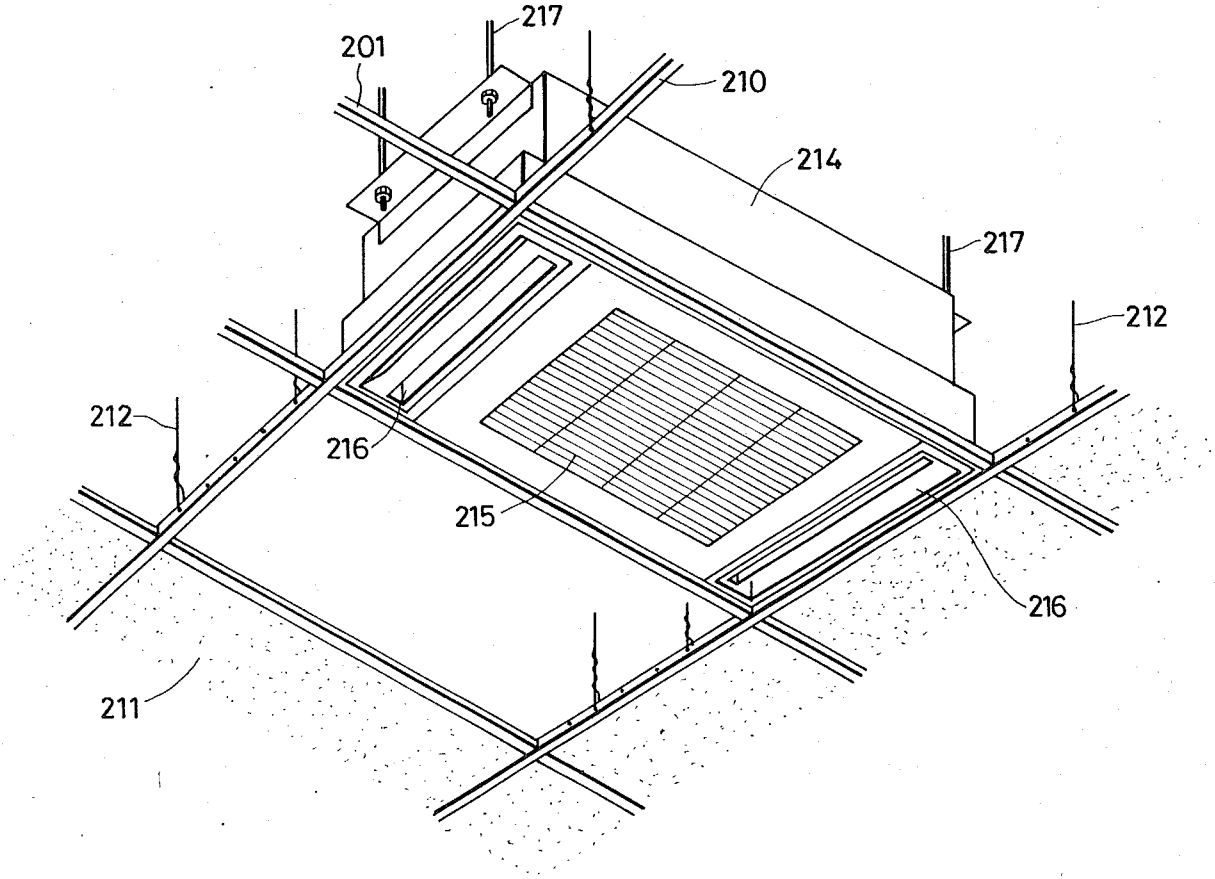
FIG. 14 is a diagram illustrating the external appearance of an installed air conditioner of a fifth embodiment of the present invention.
Figure 15:
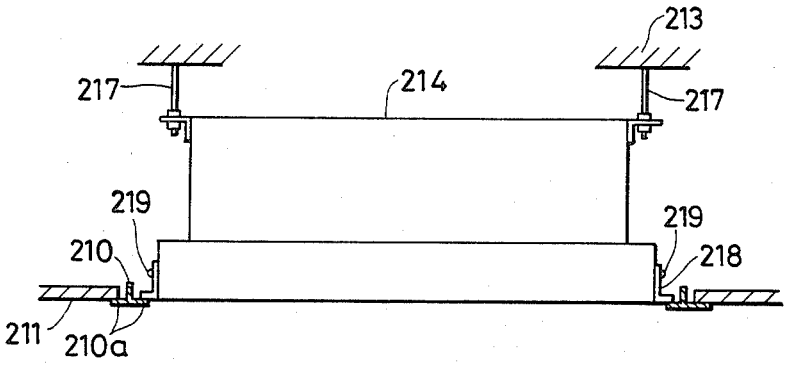
FIG. 15 and 16 are elevational and side views of the installed air conditioner of FIG. 14.
Figure 16:
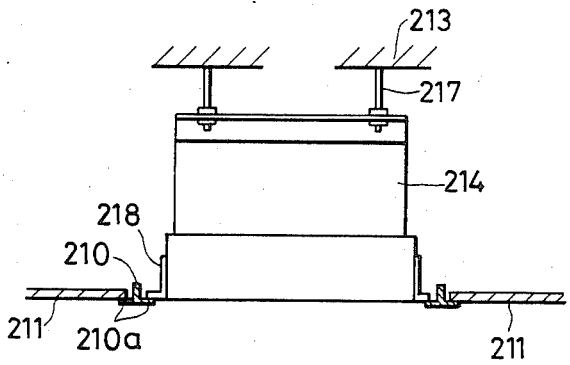
Figure 17:
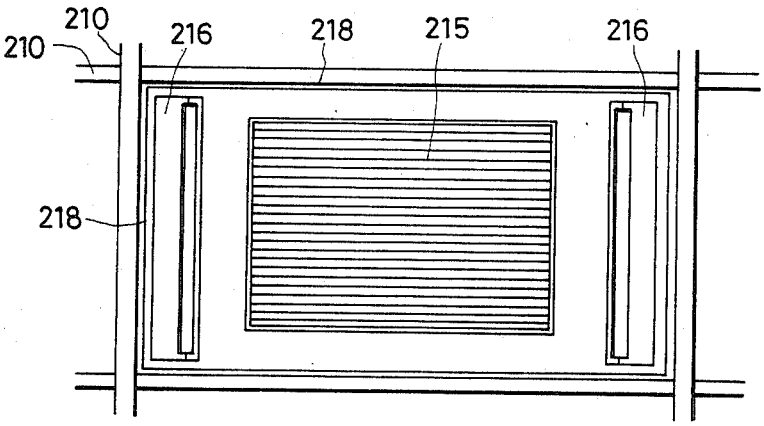
FIG. 17 is a top view of the same.

Installation efficiency will be further improved if graduations 113 are provided on the decorative frame 112, as shown in FIG. 13, and used to adjust the height thereof when it is cut.

With this construction, there is no air leakage or air short-circuiting resulting from incorrect installation as the body and the decorative panel are combined. Accordingly, stable installation becomes possible without special care because installation requires only matching the flange of the body and the opening of the ceiling plate positionally. Moreover, the decorative panel and the undersurface of the ceiling plate can be arranged on the same plane and, when the space above the ceiling plate is small, a decorative frame can be used to fill the gap between the ceiling plate and the decorative panel in the vertical direction, the decorative panel being lowered below the ceiling plate. In other words, the present invention effectively meets various requirements for installation for various interior designs at all times.

Additionally, there is achieved a reduction in package, storage and distribution costs because the air conditioner according to the present invention can be packed for shipment compactly.

Referring to the accompanying drawings, a fifth embodiment of the present invention will be described. In FIG. 14 through 17 there is shown a frame 210 which is of inverted T-shape in cross section and which is formed into a cell whose long and short sides respectively measure 2 and 4 feet. Ceiling material 211 is incorporated in each frame 210 and wires 212 are used to suspend the frame 210 from a ceiling slab 213. An air conditioner body 214 is formed so that it can be contained in the frame 210. An air intake vent 215 and air supply vents 216 are provided on the undersurface of the body 214 suspended from the ceiling slab 213 with suspension bolts 217. An L-shaped decorative cover 218 is attached to one side of the outer periphery of the body 214 with a bolt 219, and the other side thereof is made to abut the flange surface 210*a* of the frame 210 to fill the gap between the body 214 and the frame 210.

In the above-described ceiling construction, the ceiling material 211 is mounted on the flange surface 210*a* of the frame 210. Consequently, working space can be secured by pushing up the ceiling material from the inside of the room during the installation of the air conditioner, and, since the side of the body 214 is almost equal to that of the frame, the body 214 can be inserted from the inside of the room. Moreover, since the intake vent 215 and supply vents 216 are provided on the undersurface of the body 214, a short-circuited cycle of the intake and supplying air can be avoided. As the gap between the body 214 and the frame 210 is covered with the decorative cover 218, no leakage of air in the ceiling will occur.

Figure 18:
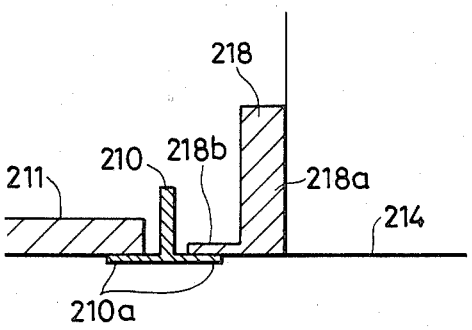
FIG. 18 is an enlarged sectional view of an installed decorative cover.
Figure 19:
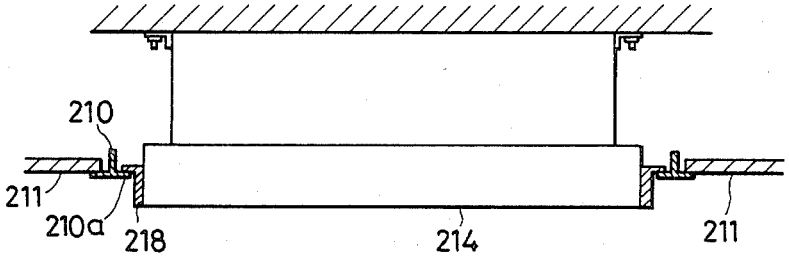
FIG. 19 is a sectional view of the installed air conditioner of a sixth embodiment.

As shown in FIG. 18, vibration during operation of the air conditioner is prevented from being transmitted to the frame 210 as one side 218*a* of the decorative cover 218 attached to the body 214 is formed from a rigid material and the other (where it makes contact with the frame 210) from a soft material. As shown in FIG. 19, moreover, the undersurface of the body 214 may be protruded from the surface of the ceiling when the space in the ceiling is low, and the decorative cover 218 may be made to abut on the flange face 210*a* of the frame 210.

As set forth above, the air conditioner body having an intake vent and supply vents on the undersurface thereof according to the present invention is arranged in one of the frames of a modular ceiling, and a decorative cover is used to fill the gap between the body and the frame. Accordingly, the external appearance of the installed air conditioner is improved without air leakage or short-circuiting of air, and further the installation work is also improved by a large margin.

Figure 20:
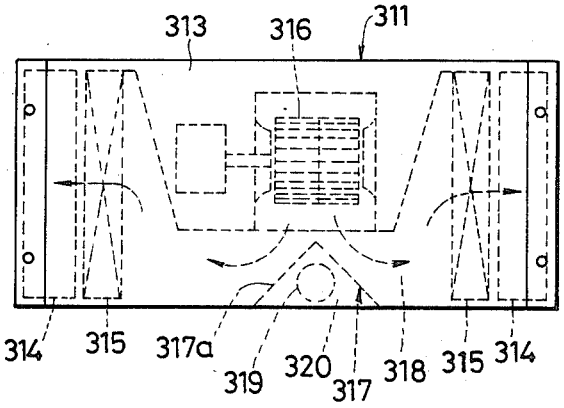
FIG. 20 is a top view of an air conditioner of a seventh embodiment of the present invention.
Figure 21:
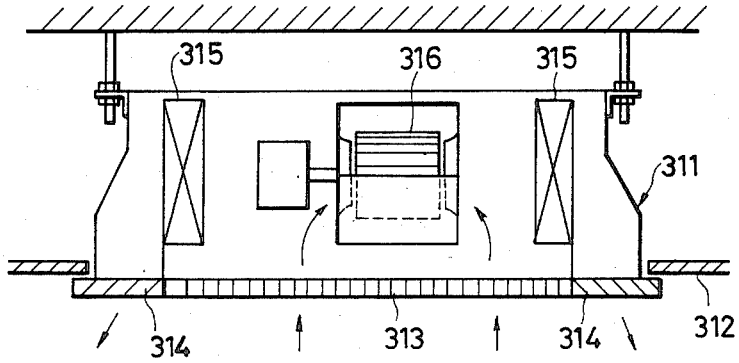
FIG. 21 is a sectional view illustrating the installation of the same in the ceiling.

FIG. 20 is a top view of an air conditioner of the seventh embodiment of the present invention, and FIG. 21 is a sectional view illustrating the installation of the same in a ceiling. In FIGS. 20 and 21, there is shown an overhead recessed air conditioner body 311 inserted and installed in the ceiling through an opening of the ceiling plate 312. The air conditioner body 311 is provided with an intake vent 313 in the central portion on the room side and supply vents 314 on both sides of the intake vent 313. A pair of heat exchangers 135 for cooling and dehumidifying air are installed opposite to each other within the air conditioner body 311. A multiblade blower 316 for sending the air to these heat exchangers 315 is arranged therebetween. A rectifier member 317 extending toward the mid-points of both supply vents 314 and having flat inclines 317 is provided in an air supply passage 318 formed between the heat exchangers 315, the external shape of the rectifier member being triangular in cross section. A chamber 320 for containing electrical parts 319 such as a drain pump is formed in the rectifier member 317. Accordingly, the dead space within the air conditioner body 311 is effectively utilizable.

Since the air conditioner thus constructed has the air conditioner body 311 provided with the intake vent 313 and the supply vents 314 on both sides thereof and the rectifier member 317 extending to the mid-points of both supply vents 314 and having the inclines 317*a* in the air supply passage 318 formed between the blower 316 and both heat exchangers 315, the air sucked in as the blower 316 rotates is led to the inclines 317*a* of the rectifier member 317 and is evenly distributed to the left and right before being blown out of the supply vents 314 and the air conditioner body 311 through both heat exchangers 315.

Figure 22:
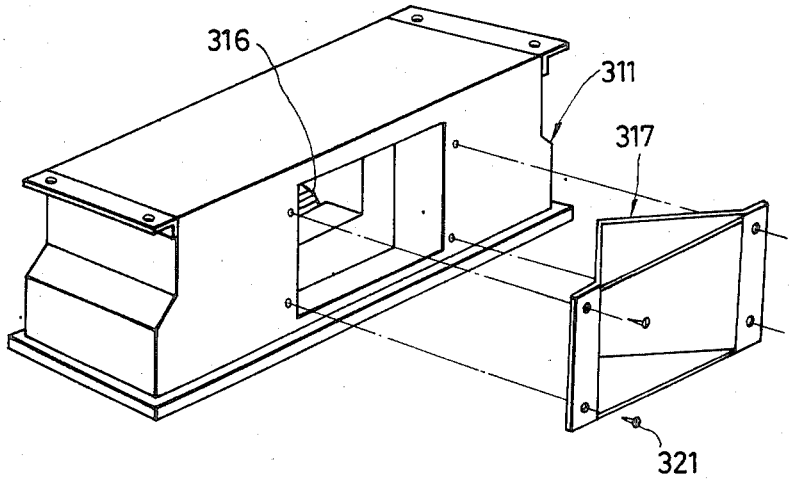
FIG. 22 is an exploded perspective view of an eighth embodiment of the present invention.

Although the rectifier member 317 is placed within the air supply passage 318 according to the above-described embodiment, the rectifier member 317 may be installed in the air supply passage 318 as shown in FIG. 22 and detachably attached to the outer wall of the air conditioner body 311 with set bolts 321, whereby the maintenance and inspection of parts such as the blower 316 can readily be made.

The inclined walls of the rectifier member 317 in the embodiment above are flat. However, these inclined walls need not always be flat and may be curved. The external shaped of the incline is also not limited to what has been defined in this embodiment and may be altered as required.

As set forth above, the air conditioner according to the present invention includes an air conditioner body having an air intake body having an air intake vent provided in the center on the room side and air supply vents provided on both sides of the intake vent, a pair of heat exchangers arranged opposite to each other within the air conditioner body, a blower installed between the heat exchanger and used to send air to the heat exchanger, and a rectifier member formed between the blower and the heat exchanger, the rectifier member being provided with inclines and extending toward the centers of both the supply vents in the air supply passage, whereby the air sucked as the blower rotates is evenly distributed to the left and right and blown out of the supply vents and the air conditioner body through the heat exchangers. Accordingly, even if the air conditioner body is located in the central portion of the ceiling, the current and temperature distribution of the air supplied to the room can be made uniform to ensure improved air conditioning effects.

Figure 23:
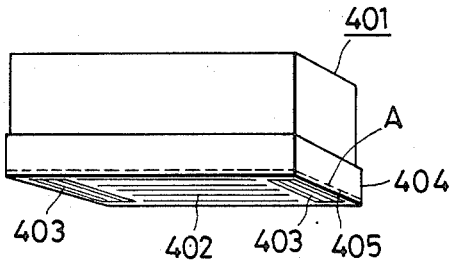
FIG. 23 is an external perspective view of an air conditioner of a ninth embodiment of the present invention.
Figure 24:
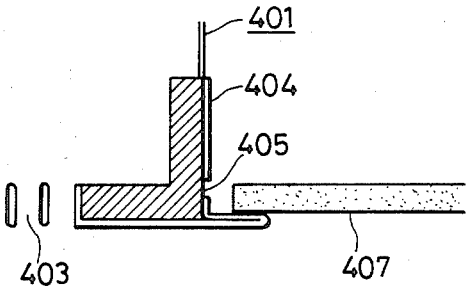
FIG. 24 is an enlarged sectional view of a portion A in FIG. 23 illustrating the construction of the same.
Figure 25:
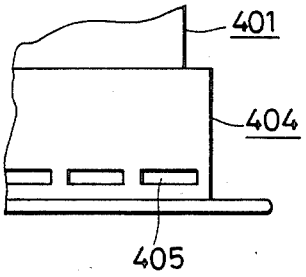
FIG. 25 is an enlarged side view of the portion A.

Referring to FIGS. 23 through 25, a ninth embodiment of the present invention will be described. In FIGS. 23 through 25, an overhead recessed air conditioner 401 is provided with a decorative panel having an intake vent 402 and supply vents 403, and a plurality of oblong slits 405 in a row are provided on the whole periphery of the lower sides of the decorative panel 404. Reference numeral 407 represents the undersurface of the ceiling.

In the air conditioner thus constructed, as shown in FIG. 24, the slits 405 provided in the lower sides of the decorative panel 404 cause the heat conductivity between the undersurface and sides of the decorative panel to be reduced; in other words, the sides of the decorative panel 404 are effectively thermally separated from its undersurface exposed to the air of the room and thus cooled. Accordingly, no dripping condensation will be produced thereto, even though high temperature humid air in the ceiling contacts the sides thereof.

Figure 26:
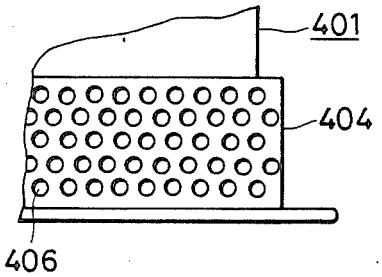
FIG. 26 is an enlarged side view, equivalent to FIG. 25, illustrating a tenth embodiment of the present invention.

Although the decorative panel 404 provided with slits 405 on its sides is shown in the above-described ninth embodiment, a number of circular or square holes in the form of punched metal may be provided on the sides as shown in FIG. 26, with the same effect as what has been described above.

As set forth above, the slits provided in the lower sides of the decorative panel allow the sides to be thermally separated from its undersurface, preventing condensation from being produced when high temperature humid air at the ceiling makes contact with the sides thereof, thus preventing problems caused by drops of condensed water.

Figure 27:
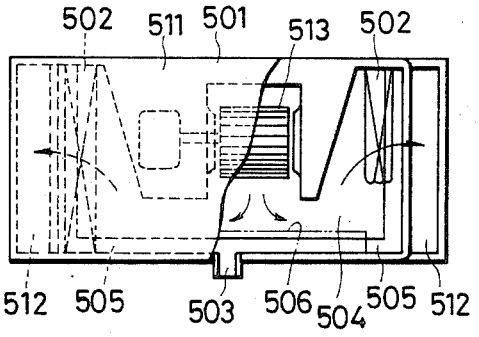
FIG. 27 is a sectional top view of the principal portion of an air conditioner of an eleventh embodiment of the present invention.
Figure 28:
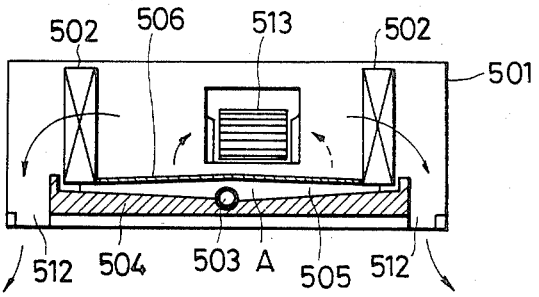
FIG. 28 is a sectional elevational view of the same.
Figure 29:
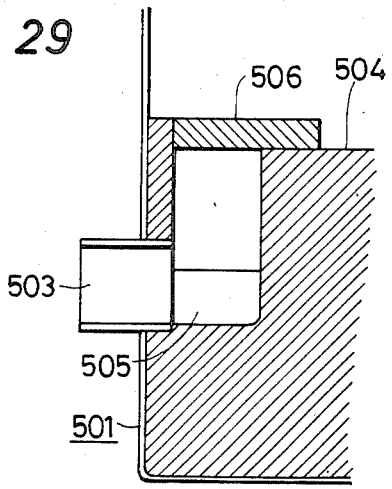
FIG. 29 is an enlarged view of the portion A of FIG. 28 illustrating the construction of the same.

FIG. 27 is a top view of an air conditioner of an eleventh embodiment of the present invention, FIG. 28 is an elevational view of the same, and FIG. 29 is an enlarged view of a principal portion of the same. In FIGS. 27 through 29, there is shown an overhead recessed air conditioner body 501 having an intake vent 511 in the central portion on the room side and supply vents 512 on both sides of the intake vent. A pair of heat exchangers 502 for cooling and dehumidifying air are arranged opposite to each other in the body. A multiblade blower 513 for sending the air to both heat exchangers is installed between the heat exchangers 502. A condensate discharge port 503 is provided for a condensate collecting pan 504 arranged under the heat exchangers 502, and a drain 505 is used to lead drainage from under the pair of heat exchangers 502 to the discharge port 503 through the pan 504, a cover 506 being employed to form the drain into a covered conduit.

In the air conditioner thus constructed, air sucked in from the intake vent 511 as the blower 513 rotates is sent to the pair of heat exchangers 502. The air is cooled and dehumidified in the heat exchangers 502 before being blown out of the supply vents 512 for air conditioning purposes. The moisture contained in the air is condensed while the air is cooled and dehumidified in the heat exchangers 502 and sent to the pan 504 under the heat exchangers 502 on the pan 504 and led to the discharge port 503 before being discharged out of the body 501.

Figure 30:
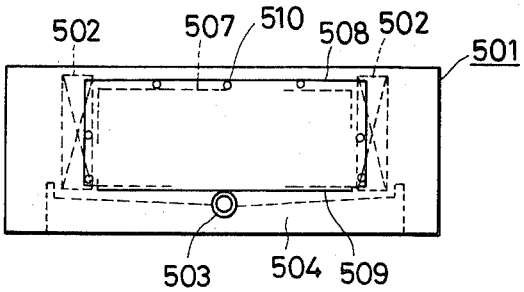
FIG. 30 is an elevational view of a twelfth embodiment of the present invention.
Figure 31:
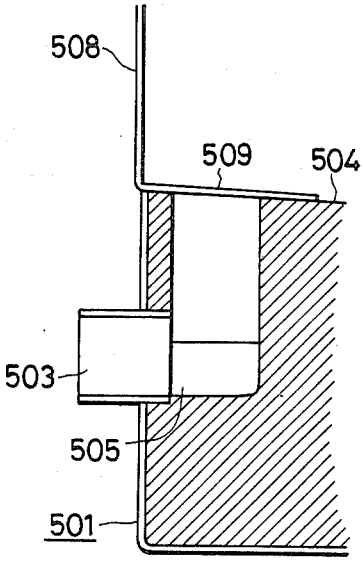
FIG. 31 is an enlarged view, equivalent to FIG. 29, illustrating the construction of a thirteenth embodiment of the present invention.

Although there is shown the drain 505 with the cover 506 on the pan 504 in the above-described eleventh embodiment, as shown in FIGS. 30 and 31, an opening 507 may be made in the outer shell of the body 501 above the discharge port 503 and used as a service port on the pan 504, whereas the lower end of the cover 508 covering the opening 507 is bent toward the inside of the body 1 to forming a bent portion 509, to employ the bent portion 509 as a cover for the drain 505, whereby the same effects as achieved above are produced.

As set forth above, the drainage flow from the condensate collecting pan to the discharge port is unaffected by the air current, ensuring an improvement of drainage and preventing the drainage from overflowing the condensate collecting pan.

We claim:

1. In an overhead recessed air conditioner having a body, the said body having a room side, an intake vent in the central portion of said body on said room side, a supply vent on each side of said intake vent, a pair of heat exchangers for cooling and humidifying air arranged opposite to each other in said body and proximate to said supply vents respectively, a blower installed between the heat exchangers for pulling room air through said intake vent and for sending said air to both heat exchangers and for discharging said air through said supply vents, a condensate collecting pan mounted on the room side of the air conditioner body and having opposite ends under said heat exchangers, and a condensate discharge port affixed to said condensate collecting pan and opening to the exterior of said body for removing said condensate collecting on said collecting pan, the improvement comprising a drain extending within said condensate pan from a position under said pair of heat exchangers to said condensate discharge port and means forming a cover over said drain along the length of said drain proximate to said intake vent such that the condensate drainage flow along the condensate collecting pan from the heat exchangers to the discharge port is unaffected by air currents produced by the blower thereby improving drainage and preventing the condensate from overflowing the condensate collecting pan.

2. The overhead recessed air conditioner as claimed in claim 1 wherein said body includes an outer shell, an opening is provided within the outer shell of said body above said condensate discharge port, an L-shaped cover is mounted to said shell to cover said opening, said drain comprises an upwardly open recess within the upper surface of condensate collecting pan and wherein, said cover includes a lower end, bent towards the inside of said body, and said bent portion, contacts said pan, overlies said recess and functions as a cover for said drain.

3. The overhead recessed air conditioner as claimed in claim 1 wherein said drain comprises an upwardly open recess within said condensate collecting pan, and wherein, a cover extends transversely between said pair of heat exchangers in contact with the upper surface of said pan, and overlies said drain, over the length of the drain between said two heat exchangers.

* * * * *